US005755052A

United States Patent [19]

Keeney

[11] Patent Number: 5,755,052

[45] Date of Patent: May 26, 1998

[54] MAGAZINE FOR RIMMED AMMUNITION

[75] Inventor: Michael D. Keeney, Elizabethtown, Ky.

[73] Assignee: Remington Arms Company, Inc., Madison, N.C.

[21] Appl. No.: 777,578

[22] Filed: Dec. 31, 1996

[51] Int. Cl.[6] ..... F41C 25/02

[52] U.S. Cl. ..... 42/50

[58] Field of Search ..... 42/50, 49.01, 49.02, 42/70.01

[56] References Cited

U.S. PATENT DOCUMENTS

| | | | |
|---|---|---|---|
| 2,515,809 | 7/1950 | Sunden | 42/50 |
| 2,828,568 | 4/1958 | Sakewitz | 42/50 |
| 3,732,643 | 5/1973 | Wells | 42/50 |
| 4,589,218 | 5/1986 | Teppa | 42/50 |
| 4,888,899 | 12/1989 | Chestnut et al. | 42/50 |
| 5,099,595 | 3/1992 | Chestnut et al. | 42/50 |

*Primary Examiner*—Michael J. Carone
*Assistant Examiner*—Matthew J. Lattig
*Attorney, Agent, or Firm*—Huntley & Associates

[57] ABSTRACT

A substantially rectilinear magazine for use with rimmed ammunition that does not extend below the belly of the firearm.

19 Claims, 6 Drawing Sheets

MAGAZINE FOR RIMMED AMMUNITION

BACKGROUND OF THE INVENTION

This invention relates generally to firearms and more particularly to an improved ammunition magazine for use with rimmed ammunition.

Magazines carrying several rounds of ammunition have long been used for a wide variety of firearms. Present magazines include those that retain single, dual, or triple stacks of rounds. Single stacks are necessarily longer than multiple stacks, and thus have a tendency to extend below the belly of the firearm. Due to the fact that the diameter of the base of rimed ammunition is larger than that of the body of the bullet, magazines for rimmed ammunition typically have a curved configuration to compensate for the size differences at opposite ends of the ammunition. Such banana clips, as they are commonly called, extend below the belly of the firearm.

SUMMARY OF THE INVENTION

The present invention provides a magazine for use with rimmed ammunition that can be inserted into a magazine well of the firearm, thus eliminating the need for the magazine to extend below the belly of the firearm.

More specifically, the present invention provides an ammunition magazine adapted to retain multiple rounds of rimmed ammunition, wherein the ammunition comprises a casing having a rimmed base and a tip; the magazine comprising a base attached to front, rear, and two side walls to form a substantially rectilinear chamber having an opening positioned above the base along the longitudinal centerline of the magazine; the magazine being adapted to retain the rounds of ammunition in staggered overlapping dual stacked relation, wherein adjacent rounds of ammunition within the magazine are parallel to each other when viewed from either side; a follower positioned within the chamber above the base adapted to support the rounds of ammunition in staggered overlapping dual stacked relation; at least one spring positioned to bias the follower upward; wherein each side wall has an upper portion having a forward portion and a rearward portion, the rearward portion further comprising retaining means adapted to limit the upward motion of the rimmed base of a round of ammunition, and whereby a round of ammunition can only exit the magazine by being urged forward; wherein the chamber is adapted to urge the tips of adjacent rounds inwardly, towards each other.

DETAILED DESCRIPTION OF THE INVENTION

The present invention will be more fully understood by reference to the drawings, which show alternate embodiments of the magazine. Variations and modifications of these embodiments can be substituted without departing from the principles of the invention, as will be evident to those skilled in the art.

Figure 1:
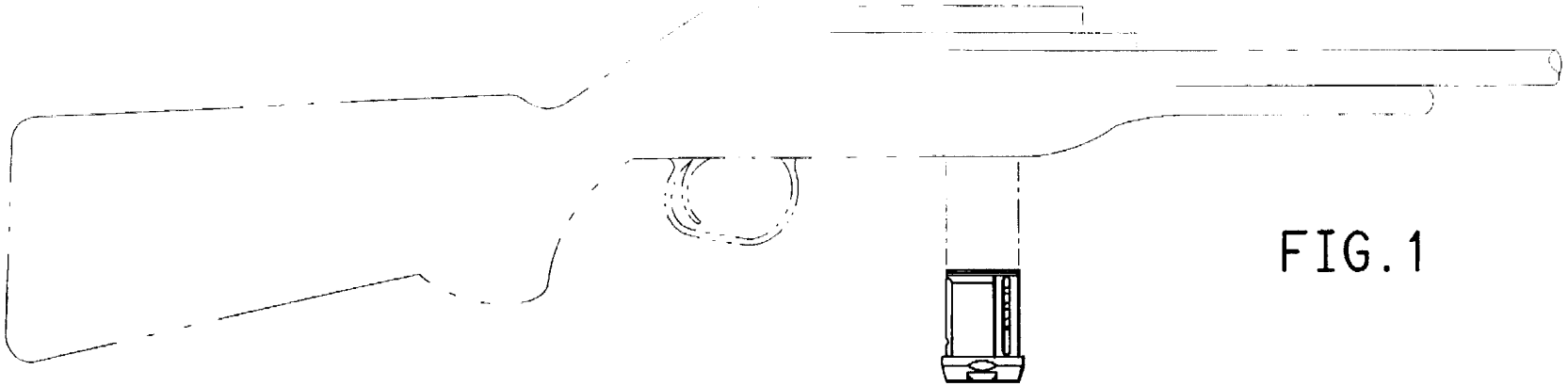
FIGS. 1 and 2 are fragmental views of a firearm with an ammunition magazine according to the present invention.
Figure 2:
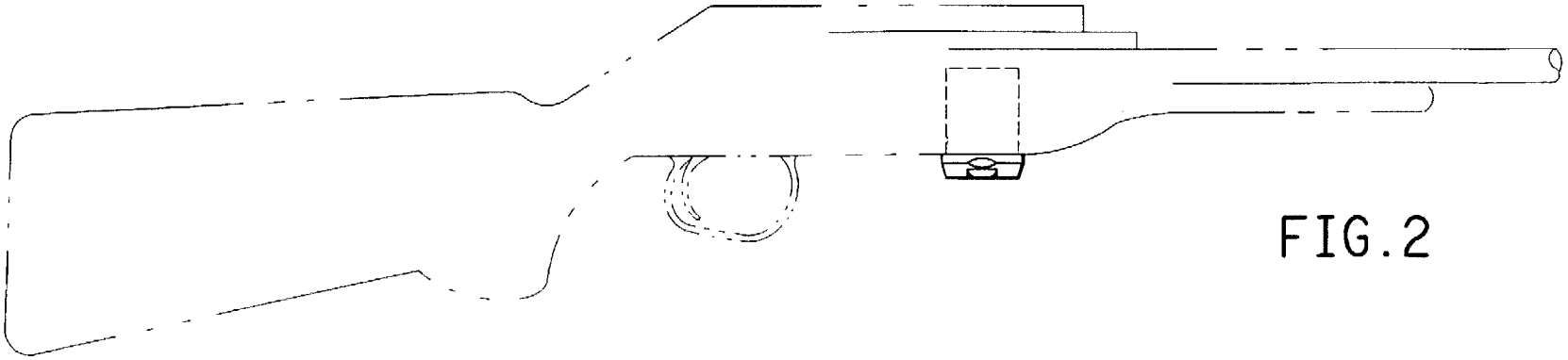

FIGS. 1 and 2 show a firearm having a magazine of the present invention. FIG. 1 shows magazine 10 in proximity to, but not inserted in, a firearm. FIG. 2 shows magazine 10 inserted into a firearm.

Figure 3:
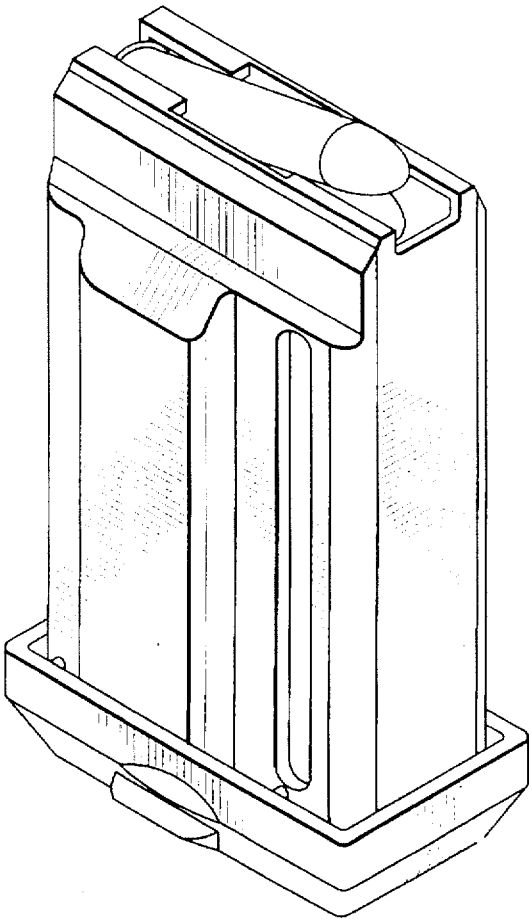
FIG. 3 is a perspective view of an ammunition magazine according to the present invention.
Figure 4:
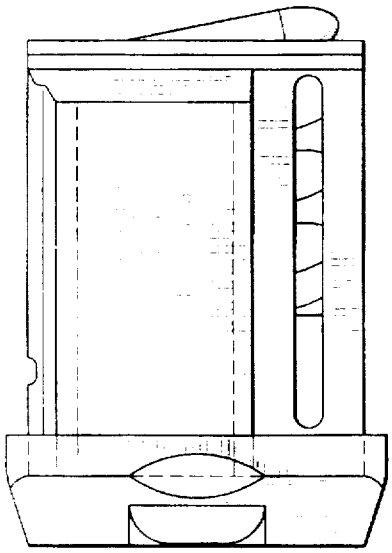
FIGS. 4 and 5 are left and right side elevation views, respectively, of an ammunition magazine according to the present invention.
Figure 5:
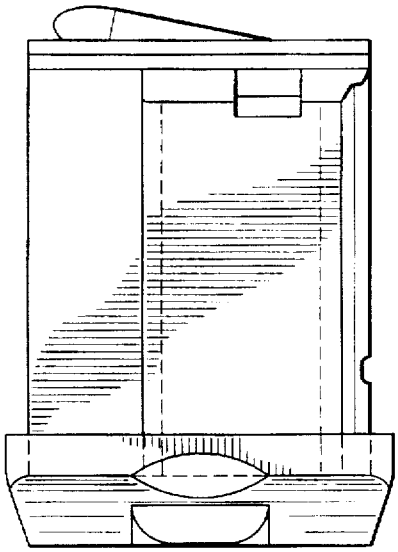
Figure 6:
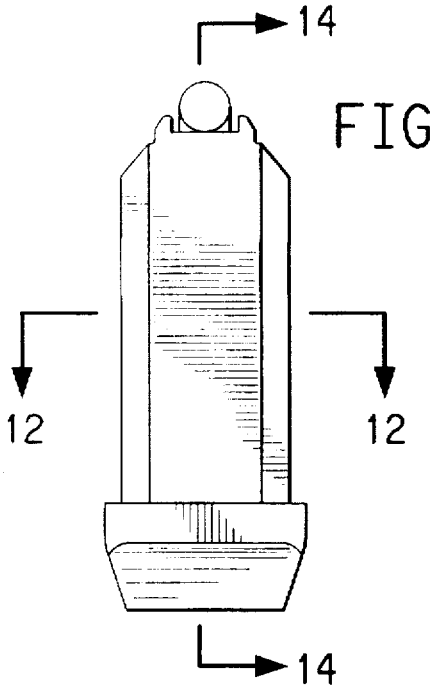
FIGS. 6 and 7 are front and back end views, respectively, of an ammunition magazine according to the present invention.
Figure 7:
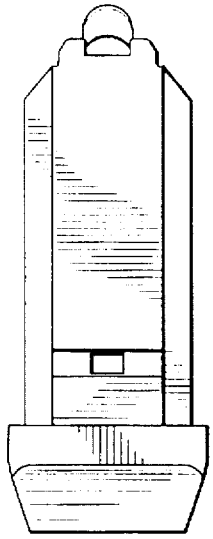
Figure 8:
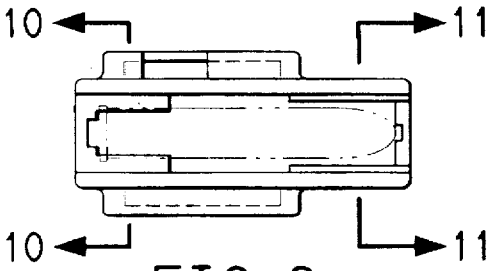
FIG. 8 is a top plan view of an ammunition magazine according to the present invention.

FIGS. 3–18 show a first embodiment of a magazine of the present invention. As shown in FIG. 3, magazine 10 comprises a base 20 and a substantially rectilinear chamber 21. FIGS. 4–8 are right side, left side, front, back and top plan views, respectively, of a first embodiment of a magazine 10 of the present invention. The magazine has side walls 11 and 12 which comprise projections wherein side cam cuts 30A and 30B, shown in phantom, are formed. The magazine has front 13 and rear 14 walls in which are formed cam cuts 31A and 31B, respectively. One side wall of the magazine has a vertically extending window 15 through which rounds of ammunition within the magazine may be seen. The other side wall has a window 16 formed at the top of the cam cut formed in that side wall. An aperture 19 formed in the rear wall of the magazine is adapted to interact with a latch tab (not shown) in the firearm to retain the magazine within the firearm.

Each side wall has an upper portion, the rear of which comprises retaining means 17. Retaining means 17 contacts the rear of a round of ammunition at the top of the magazine, retaining the top round in the magazine until it is pushed forward toward the chamber of the firearm.

Figure 9:
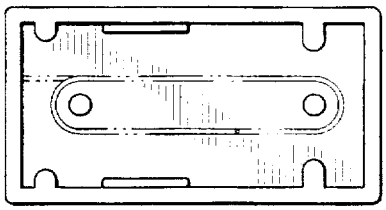
FIG. 9 is a plan view of a base of an ammunition magazine according to the present invention.
Figure 10:
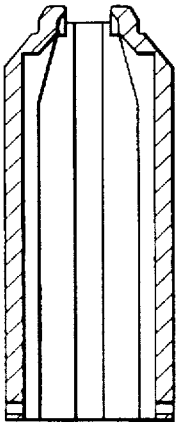
FIGS. 10–12 are section views of an ammunition magazine according to the present invention without ammunition or a base.
Figure 11:
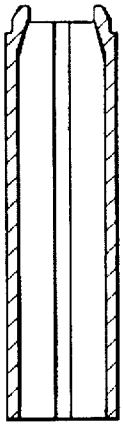
Figure 16:
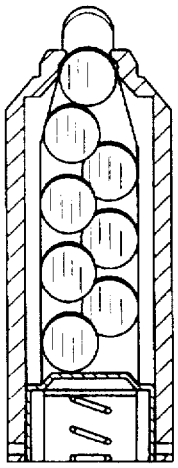
Figure 18:
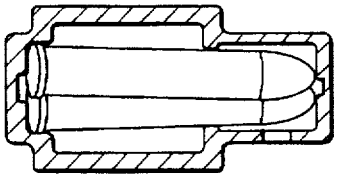
Figure 17:
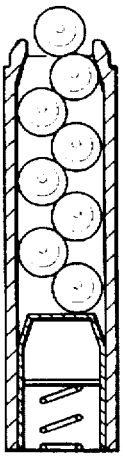
Figure 19:
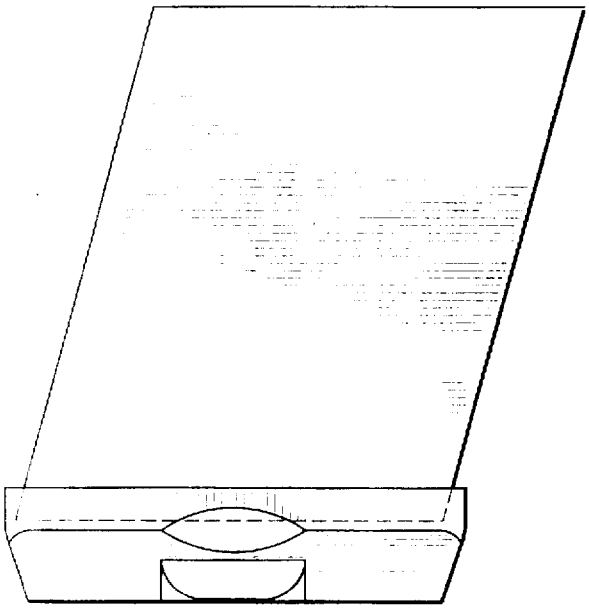
FIGS. 19–24 are elevation, plan and section views of another embodiment of an ammunition magazine according to the present invention with a substantially trapezoidal chamber.
Figure 20:
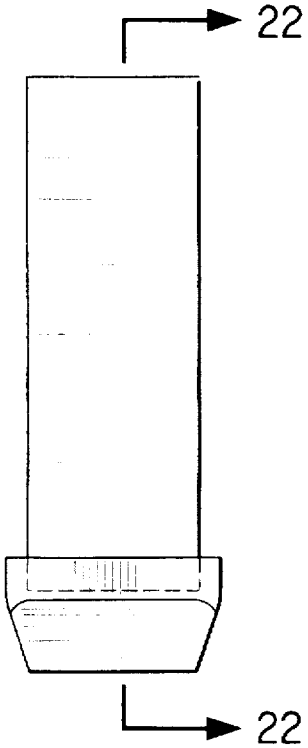
Figure 21:
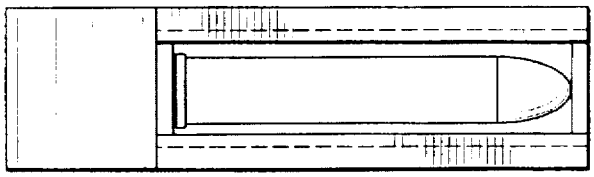
Figure 22:
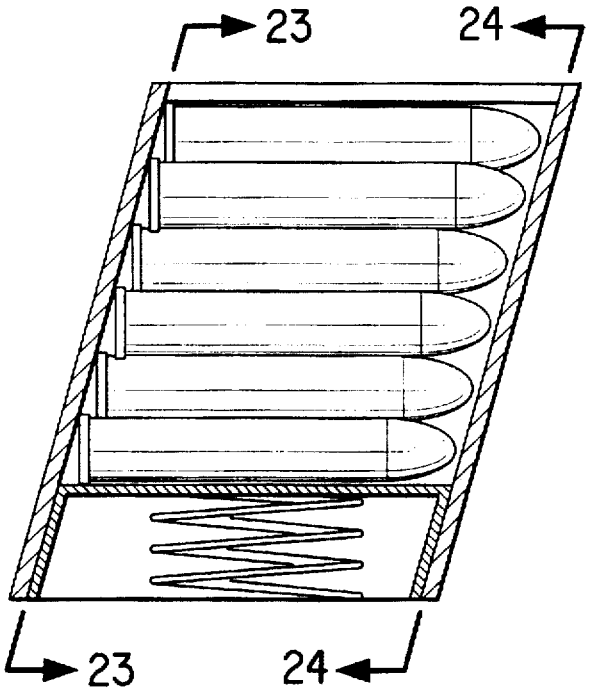
Figure 23:
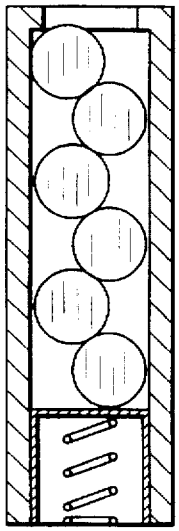
Figure 24:
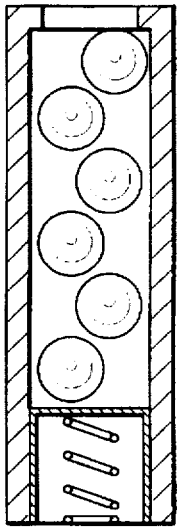

As shown in FIG. 9, spring 41 is attached to base 20. Spring 41 biases follower 40 upward as shown in FIGS. 16 and 17.

The upper portion of each side wall further comprises opposing slots 22 and 23 that are angled upward toward the front of the magazine. These slots are adapted to interact with the rim of a topmost round of ammunition, urging the base of the round upward as the round is urged forward by a bolt within the firearm.

FIGS. 10–18 show various sectional views of a first embodiment of a magazine according to the present invention. These sectional views are taken along the indicated lines in FIGS. 6, 8 and 14.

In a preferred embodiment, as shown in FIGS. 10, 11, 16 and 17, the upper portion of side walls 11 and 12 are angled toward the centerline of the magazine. The transition portions 24 and 25 of the side walls urge the rounds toward the centerline of the magazine as each successive round nears the top of the magazine.

Figure 13:
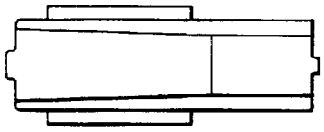
FIG. 13 is a top plan view of a follower of an ammunition magazine according to the present invention.
Figure 14:
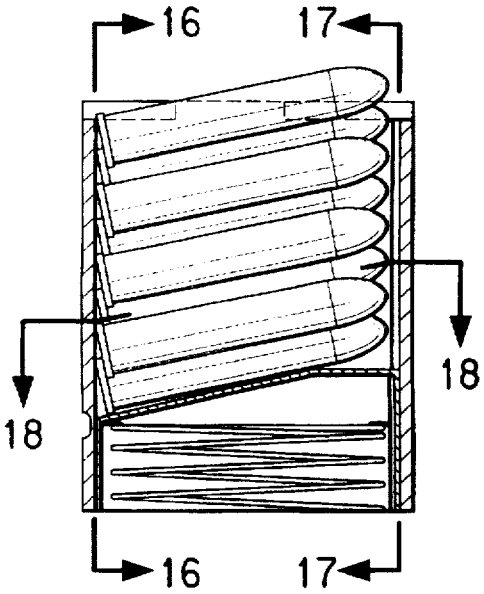
FIGS. 14–18 are section views of an ammunition magazine according to the present invention with ammunition shown but without a base.
Figure 15:
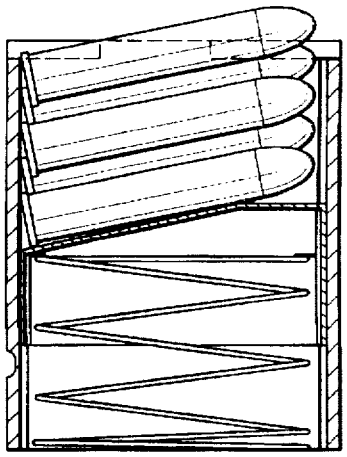

The magazine of the present invention is adapted to retain multiple rounds of ammunition in staggered overlapping dual stack relation, wherein adjacent rounds are positioned at alternate sides of the magazine, but overlap slightly along the longitudinal centerline of the magazine as shown in FIGS. 14–17. Because the rounds are arranged in staggered overlapping dual stack relation within the magazine box, the follower 40 only contacts the bottom round as shown in FIGS. 14–17. In contrast, in a typical double stack magazine, the follower contacts two rounds, the bottom round of each stack. As a result of the contact between the follower and a single round which is not centrally located within the magazine, the force provided by the spring is directed askew. To counteract the tendency for the follower to lean, follower 40 can be provided with cam keys which interact with cam cuts in the walls of the magazine to keep the follower aligned. Such an arrangement is shown in FIG. 13, where follower 40 is provided with cam keys 40A, 40B, 41A and 41B. These cam keys are adapted to fit into cam cuts 30A, 30B, 31A and 31B, respectively.

Typically, the upper surface of the follower is slanted to elevate the front end of each rounds of ammunition. While this angle of elevation can vary widely, angles of about from 10° to 15° can be used effectively, and an angle of about 12.5° has been found to be particularly satisfactory.

Figure 12:
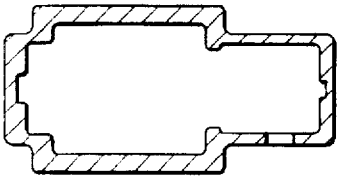

The inwardly extending tabs 32 shown in FIG. 12 are positioned to contact the casing of each round of ammunition at the point closest to the tip to prevent contact with the lead bullet which could deform the bullet. In alternate embodiments, the magazine side walls are tapered and are closer together in the front end of the magazine than the rear end. In such embodiments, there is no need for tabs to urge the tips of each round of ammunition inward, as the inwardly tapered side walls accomplish this function. To prevent contact between the magazine side walls and the lead tip of a round, a pair of substantially vertically extending grooves can be formed in the forward end of each side wall.

FIGS. 19–24 show an alternate embodiment of a magazine according to the present invention. The magazine 50 comprises a base 51 and a substantially trapezoidal chamber 52. Follower 53 is biased upward by spring 54. Follower 50 is only in contact with the round immediately above follower 50. In this alternate embodiment, each successive round is above and forward relative to the round below. The substantially trapezoidal chamber biases each round forward as it is pushed from the magazine into the chamber of the firearm.

Embodiments of the magazine of the present invention provide a desirable combination of advantages. Specifically, the present invention provides an ammunition magazine that is compact, is easily loaded, and functions reliably. In addition, the compact configuration permits the magazine to not extend substantially below the bottom of the firearm into which the magazine is inserted.

I claim:

1. An ammunition magazine adapted to retain multiple rounds of rimmed ammunition, wherein the ammunition comprises a casing having a rimmed base and a tip;

the magazine comprising a base attached to front, rear, and two side walls to form a substantially rectilinear chamber having an opening positioned above the base along the longitudinal centerline of the magazine;

the magazine being adapted to retain the rounds of ammunition, except for the topmost round, in staggered overlapping dual stacked relation, wherein adjacent rounds of ammunition within the magazine are parallel to each other when viewed from either side;

a follower positioned within the chamber above the base adapted to support the rounds of ammunition in staggered overlapping dual stacked relation;

at least one spring positioned to bias the follower upward;

wherein each side wall has an upper portion having a forward portion and a rearward portion, the rearward portion further comprising retaining means adapted to limit the upward motion of the rimmed base of a round of ammunition, and whereby a round of ammunition can only exit the magazine by being urged forward;

wherein the chamber is adapted to urge the tips of adjacent rounds inwardly, towards each other.

2. A firearm of claim 1 wherein the rearward portion of the upper portion of each side wall is angled inward towards the other side wall, both portions comprising the retaining means.

3. A magazine of claim 1 wherein the upper portions of the side walls comprise opposing inwardly extending feed lips, which, together with the upward force from an adjacent round positioned below a topmost round, prevent the topmost round from moving upward.

4. A magazine of claim 1 wherein the upper portions of the side walls are angled towards each other to form a tapered transition zone, the transition zone extending from a substantially rectilinear lower portion of the chamber to an opening positioned above the base along the longitudinal centerline of the magazine.

5. A magazine of claim 4 wherein the follower has a tapered top adapted to interact with the transition zone.

6. A magazine of claim 4 wherein each round of ammunition is directed to the longitudinal centerline of the magazine as it is urged upward by the follower and inward by the upper portions of the side walls.

7. A magazine of claim 1 adapted to retain the rounds of ammunition wherein the tip of each round of ammunition is elevated relative to its rimmed base.

8. A magazine of claim 1 adapted to retain the rounds of ammunition wherein the base of each round is positioned forward of the base of the adjacent round below, wherein the magazine is trapezoidal when viewed from either side.

9. A magazine of claim 1 wherein the follower has a front, a rear, and two sides, and each side of the follower has at least one cam key.

10. A magazine of claim 1 wherein the follower has at least one cam key in the front, rear, and each side.

11. A magazine of claim 9 wherein the chamber comprises at least one cam cut formed in each side wall of the magazine, each cam cut extending upward from a position adjacent the base, each cam cut being adapted to interact with the at least one cam key on each side of the follower.

12. A magazine of claim 1 wherein the side walls further comprise at least one pair of opposing tabs extending inwardly towards each other, the tabs extending upward from a position adjacent the base, wherein the tabs are adapted to urge the tips of adjacent rounds inwardly, towards each other.

13. A magazine of claim 12 wherein the tabs are positioned to contact each round of ammunition at a point forward of the center of gravity of that round.

14. A magazine of claim 12 wherein the tabs are positioned to contact the casing of each round of ammunition at the point closest to the tip without contacting the tip.

15. A magazine of claim 1 wherein the distance between the side walls is less at the front of the magazine than the distance between the side walls at the rear of the magazine, forming a chamber that is tapered from rear to front wherein the tips of adjacent rounds are urged inwardly, towards each other.

16. A magazine of claim 1 wherein the follower is urged upward by at least one spring positioned above the base of the magazine.

17. A magazine of claim 16 wherein the follower is urged upward by a spring of unitary construction.

18. A magazine of claim 1 wherein the distance between the two inwardly extending side walls that define the retaining means is less than the diameter of the rimmed base of a round of ammunition within the chamber.

19. A magazine of claim 11 wherein the chamber further comprises at least one cam cut formed in each of the front and rear walls of the magazine, each cam cut extending upward from a position adjacent the base, each cam cut being adapted to interact with the at least one cam key on the front and rear of the follower.

* * * * *